US006419182B1

(12) United States Patent
Jansky

(10) Patent No.: US 6,419,182 B1
(45) Date of Patent: Jul. 16, 2002

(54) WIRE DISPENSING UNIT

(76) Inventor: Jimmy Jansky, 691 CR 283, Edna, TX (US) 77957

( * ) Notice: Subject to any disclaimer, the term of this patent is extended or adjusted under 35 U.S.C. 154(b) by 0 days.

(21) Appl. No.: 09/714,708

(22) Filed: Nov. 15, 2000

Related U.S. Application Data

(60) Provisional application No. 60/166,063, filed on Nov. 17, 1999.

(51) Int. Cl.[7] ..... B65H 16/02

(52) U.S. Cl. ..... 242/557; 242/559.4; 242/560.2; 242/594

(58) Field of Search ..... 242/557, 559.4, 242/560.2, 594, 597.7

(56) References Cited

U.S. PATENT DOCUMENTS 5,449,224 A * 9/1995 Johnson ..... 298/2

* cited by examiner

*Primary Examiner*—Donald P. Walsh
*Assistant Examiner*—Jonathan R. Miller
(74) *Attorney, Agent, or Firm*—Jackson Walker L.L.P.; Cline H. White

(57) ABSTRACT

The present invention consists of a rolled wire dispensing unit that incorporates a wheeled cart with a deck, a post generally perpendicular to the deck over which a roll of wire may be placed, and a pivoting front yoke. The yoke is attached to the deck slightly rearward of the front edge of the deck so as to allow the front end of the unit to tilt upward and allow the wire roll to be pulled from the post prior to the wire breaking if the wire becomes overly taut. While the unit will allow the wire roll to pull off if the wire becomes overly tight, the unit uses the wire roll's own weight to maintain a degree of tautness as the wire is dispensed. These improvements benefit the user by providing a convenient wire dispensing tool, that eliminates the inconvenience and danger caused by wire snags.

5 Claims, 4 Drawing Sheets

WIRE DISPENSING UNIT

This application claims the benefit of U.S. provisional application No. 60/166,063, filed Nov. 17, 1999.

BACKGROUND OF THE INVENTION

The present invention relates to a wire dispensing unit and wire dispensing method for use in laying and stretching wire, particularly fencing wire. Specifically, the invention relates to a cart upon which a roll of wire is held, and a method for dispensing the wire while simultaneously keeping the wire generally taut.

Existing wire dispensers hold rolls or wire and allow the wire to unroll as they are pulled along the desired path, however they suffer from not having a mechanism by which the roll is released if the wire becomes snagged and cannot continue to be dispensed. Because of the various types of terrain over which fencing must be laid, it is not uncommon to have the wire being laid snag. In conventional wire dispensers if the wire becomes snagged, then unless the operator is immediately aware of the snag, the operator is likely to continue to pull the dispensing unit. While, if the operator is pulling the dispensing unit by hand, a snag is likely to be noticed before any damage is done, an operator who is using a vehicle to pull the dispensing unit is less likely to discover the snag and the vehicle will continue to pull until there is a failure along the wire, either the wire will break, the object anchoring the wire will dislodge, or the dispensing unit will be damaged. At the very least, this occurrence will cost additional time and effort to repair the damage, and in a more severe consequence, there can be additional financial costs, or in the worst case, the wire may snap, hitting and injuring the operator or a bystander.

The improved wire dispensing unit of the present invention incorporates a wheeled cart with a deck, a post generally perpendicular to the deck over which a roll of wire may be placed, and a pivoting front yoke attached to the deck slightly rearward of the front edge of the deck so as to allow the front end of the unit to tilt upward and allow the wire roll to be pulled from the post prior to the wire breaking if the wire becomes overly taut. The unit may be pulled by various types of motorized vehicles, yet may have a handle and is light enough to be pulled by a person. The unit has a high center clearance to allow it to roll over many of the obstacles that may be encountered in the field. While the unit will allow the wire roll to pull off if the wire becomes overly tight, the unit uses the wire roll's own weight to maintain a degree of tautness as the wire is dispensed. These improvements benefit the user by providing a convenient wire dispensing tool, that eliminates the inconvenience and danger caused by wire snags. Also, the unit may be modified to have multiple posts so that multiple rolls of wire may be unrolled simultaneously. Finally, an alternative embodiment of the present invention incorporates a un-shaped swing-arm assembly attached to the frame that has a wire bar upon which a roll of wire may be placed. When not being unrolled, the wire roll may be swung up over the deck, and when being unrolled it may be swung down behind the unit.

SUMMARY OF THE INVENTION

The present invention includes a wire dispensing unit which incorporates a high center clearance, wheeled frame which enables the unit to roll over many of the obstacles that may be encountered in the field. The invention further includes an upright post about which a roll of wire may be placed. While it is possible to incorporate a rotatable spindle to support the wire roll, the present invention allows the weight of the wire roll to add tension to the wire such that excess wire coils are not allowed to unravel and the wire is released in a semi-taut condition. The unit incorporates a yoke that is pivotally connected to the frame along an axis perpendicular to the direction of travel and parallel to the ground. The pivot connection of the yoke is set back from the front edge of the frame and allows the frame front portion to rise off the ground if the wire becomes overly taut. The wire itself will then pull the wire roll up and off of the upright post. In this manner, if the wire has snagged such that it will not unroll, then the wire roll is ejected and time is saved for the operator, who does not have to splice the wire, but only unsnarl and reset the wire roll. The chance of damage to equipment and injury to the operator from snap-back of a broken wire are minimized. Although the unit is light enough that an operator can pull it by hand, the yoke is equipped with a hitch unit that the operator can connect to a tractor or other machinery to pull the device.

The unit is designed so that a multi-post deck can be used. The multi-post deck has an alignment hole that the unit post extends through. This aligns and helps secure the multi-post deck. The multi-post deck is further secured by bolts along a securing lip, or by other means. The multi-post deck has additional upright posts over which additional rolls of wire may be placed and unstrung. If any of the wire rolls become snagged, the unit will still act to eject the rolls. Of course, the unit could be designed such that the original deck has multiple posts.

Finally, an alternative embodiment of the present invention provides for a swing-arm assembly rotatably attached to the rear portion of the wire dispensing unit. The swing-arm assembly consists of a curved rod that swings upwardly and forward over the deck of the wire dispensing unit, or downwardly and back toward the ground behind the wire dispensing unit. The portion of the swing-arm assembly that is not attached to the wire dispensing unit is constructed such that it can be inserted into a roll of wire, and the roll of wire removably attached thereto. The swing-arm assembly allows the wire roll to rotate about the swing-arm assembly so that the wire can be unrolled. When swung forward, the swing-arm assembly keeps the wire roll up and out of the way. When dropped down, the wire roll can be unrolled with its own weight providing tension and stretching of the wire. Dependent upon the size of the wire rolls to be dispensed relative to the wire dispensing unit, the may be multiple swing arms attached to the wire dispensing unit.

BRIEF DESCRIPTION OF THE DRAWINGS

The invention will be better understood and objects other than those set forth above will become apparent when consideration is given to the following detailed description of the preferred embodiments. Such description makes reference to the annexed drawings wherein.

DETAILED DESCRIPTION OF THE PREFERRED EMBODIMENT

Turning to the figures, it may be seen that the wire dispensing unit concept of the present invention includes a pull able, rolling cart or frame, an upright.

Figure 1:
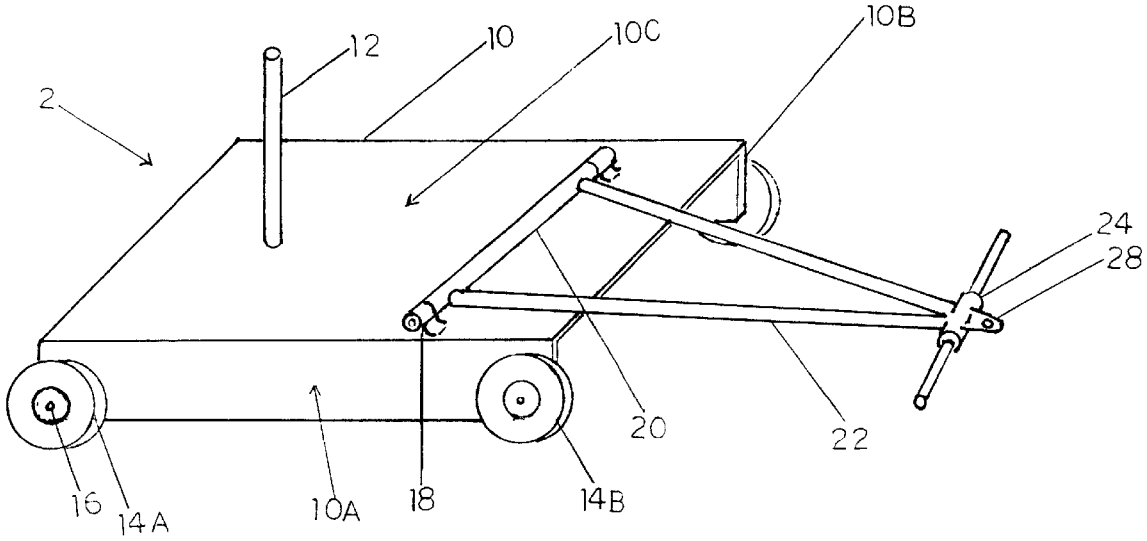
FIG. 1 shows a perspective view of the wire dispensing unit.

FIG. 1 illustrates that the wire dispensing unit (2) includes a frame (10) which rolls along the ground on wheels (14) which are connected to the frame by axle (16). A roll of wire (not shown) is placed on the frame deck (10*c*) such that the post (12) extends up through the center axis of the cylindrically coiled wire roll. A yoke (22) having pulling means such as a handle (24) and/or hitch (28) is connected to a pivot bar (20). The pivot bar (20) is connected to the frame (10) by hinge(s) (18). The hinge (18) allows the yoke (22) to vertically pivot in order to allow the yoke (22) to be hitched to a tractor, 4-wheeler, or other machinery. The hinge (18) is set back from the frame front edge (26). This set back allows the frame (10) to tilt upward if the wire becomes snagged and the wire is no longer unrolling with the frame's (10) front wheels (14*b*) rising up off of the ground and the rear wheels (14*a*) staying in contact with the ground. Different embodiments of the wire dispensing unit (2) may employ varying numbers of wheels (14*a* and 14*b*). For example, the wire dispensing unit (2) may be constructed with two wheels (14) and the wire dispensing unit (2) would function in the manner as described herein.

Figure 2:
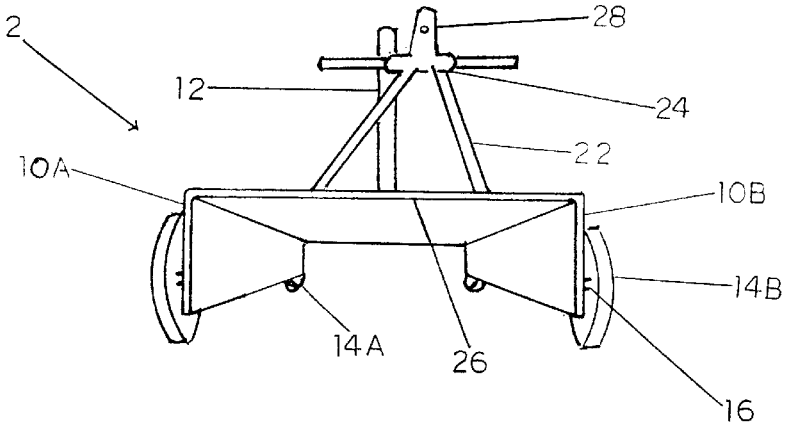
FIG. 2 shows a front elevation view of the wire dispensing unit.

FIG. 2 shows a front elevation view of the wire dispensing unit (2). This figure illustrates the clearance that the frame (10) allows the wire dispensing unit (2) to have. While the wheels 14 roll along the ground during use, many obstacles such as rocks, roots, and other debris, can pass under the center of the frame (10). This is due to the frame (10) having a generally "C" type shape with the center portion of the frame (10) elevated off of the ground.

Figure 3:
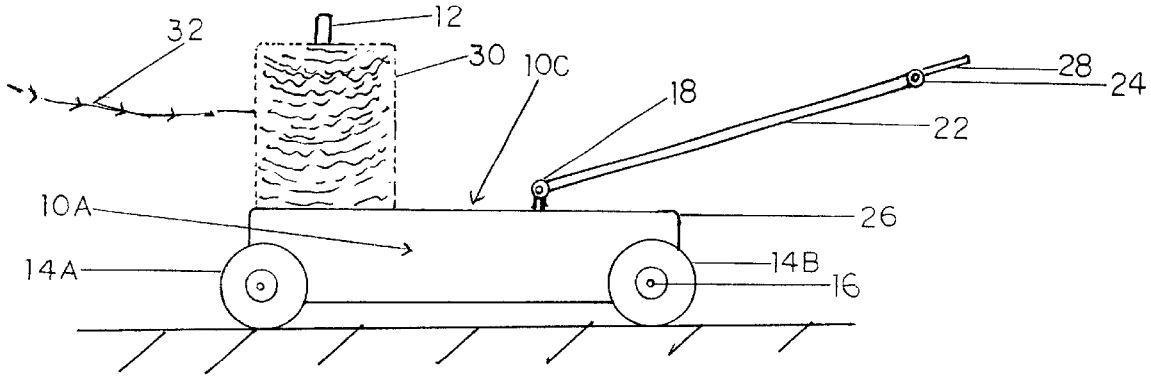
FIG. 3 shows a side elevation view of the wire dispensing unit in its normal, wire dispensing position.
Figure 4:
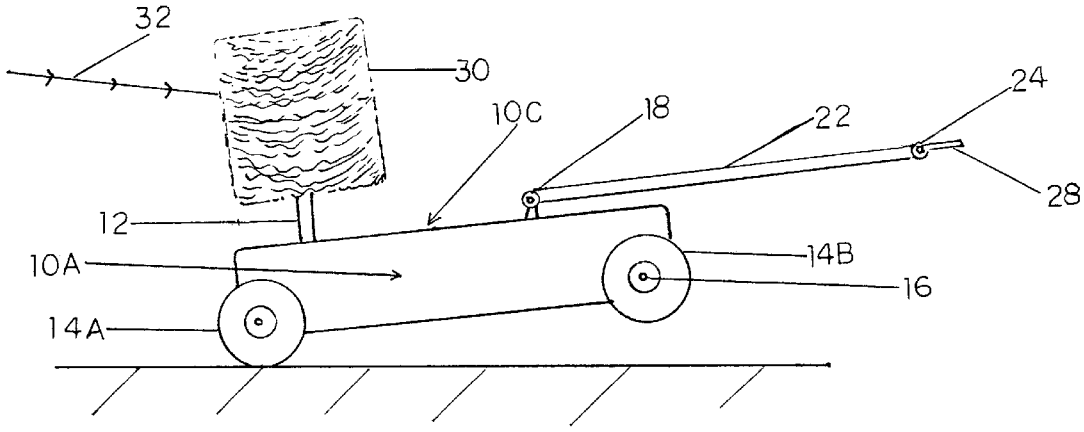
FIG. 4 shows a side elevation view of the wire dispensing unit in position to eject a roll of wire.

FIGS. 3 and 4 illustrate the capability of the wire dispensing unit (2) to eject the roll of wire roll (30).

FIG. 3 illustrates the wire dispensing unit (2) in its standard wire dispensing orientation. The frame (10) is generally horizontal to the ground with each of the wheels (14) generally contacting and rolling along the ground. The wire roll (30) sets on the frame deck (10*c*) and rotates about the post (12) as the wire dispensing unit (2) is pulled along the ground. The yoke (22) is in a slightly elevated position such that the handle (24) and hitch (28) are in a pulling position. As can be seen from this figure, the pivot bar (20) is connected to the frame deck (10*c*) by hinge (18) at a position distal from the frame front edge (26).

FIG. 4 illustrates the wire dispensing unit (2) during the occurrence of the wire (32) becoming snagged and ceasing to unroll. As the wire dispensing unit (2) is pulled in a forward direction, the wire strand (32) becomes overly taut and the force exerted by the wire strand (32) on the post (12) causes the post (12) to act as a cantilever on the wire dispensing unit (2) with a pivot point along the pivot bar (20) and pivoting about the hinges (18). The front wheels (14*b*) raise off the ground to the extent that the frame deck (10*c*) and the yoke (22) become generally parallel. The rear wheels (14*a*) remain in contact with the ground. The resultant angle of the post (12) allows the tighten wire (32) pull the roll of wire (30) up from the frame deck (10*c*) and off of the post (12) without the wire (32) breaking. After unsnarling the wire (32), the user can then replace wire roll (30) about the post (12) on the frame deck (10*c*) and continue dispensing the wire (32).

Figure 5:
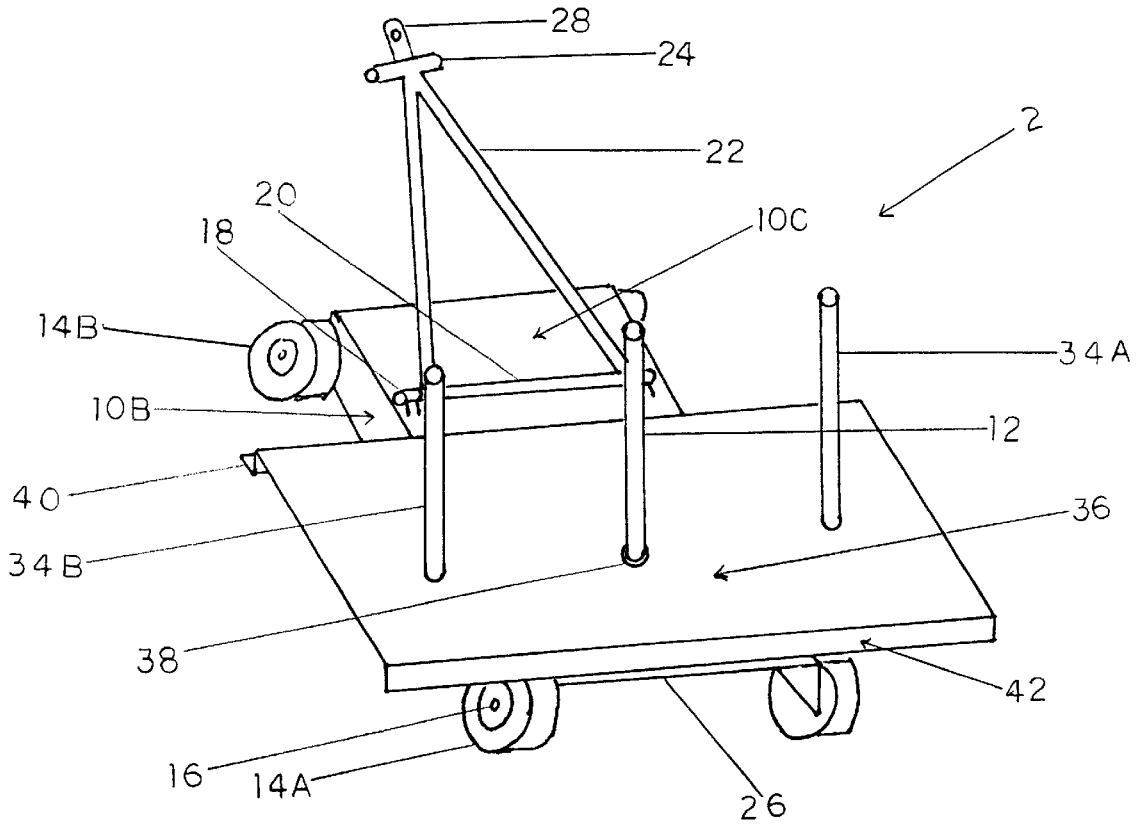
FIG. 5 shows a perspective view of the wire dispensing unit with the multi-post deck in place.

FIG. 5 shows a perspective view of the wire dispensing unit (2) with the multi-post deck (42) in place. In this alternative embodiment, the multi-post deck (42) is in place on top of the wire dispensing unit (2). The alignment hole (38) is slid down about the post (12), ensuring that the multi-post deck (36) is correctly positioned, aiding in securing the multi-post deck (36) to the wire dispensing unit (2), and allowing the post (12) to continue to be used to hold a roll of wire. The multi-post deck (36) can be slightly raised by a the multi-post deck front (42), which is adjacent to the frame front edge (26), and a securing lip (40). One or more upright posts, shown in FIG. 5 as (34A) and (34B) extend upwardly from the multi-post deck (36) for holding additional rolls of wire. The remaining portions of the wire dispensing unit (2) are in the standard configuration and work as described supra.

Figure 6:
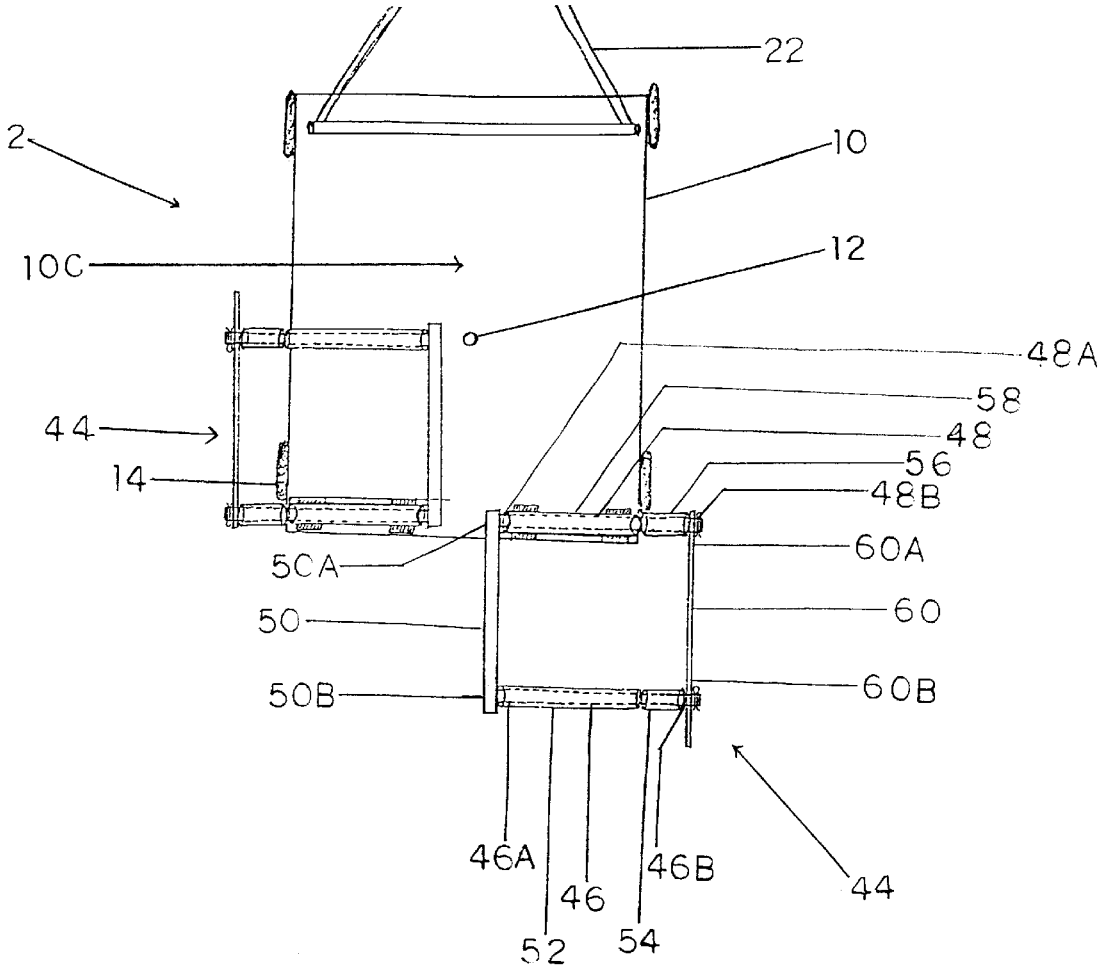
FIG. 6 shows a top view of the wire dispensing unit with two swing-arm assemblies in place.

FIG. 6 shows a top view of an alternative embodiment of the wire dispensing unit with two swing-arm assemblies (44) attached, one assembly (44) in the forward position, and one assembly (44) in the rearward position. In this alternative embodiment, a swing-arm hinge (58) is attached to the frame deck (10*c*) of the wire dispensing unit (2). Rotatably inserted in the swing-arm hinge (58) and extending beyond the swing-arm hinge (58) on both ends is a swing bar (48). The swing bar (48) is attached, in a generally perpendicular manner, at its first end (48*a*) to the first end (50*a*) of a side bar (50). The swing bar (48) is removably attached at its second end (48*b*) to the first end (60*a*) of a retaining bar (60). The side bar (50) is attached, in a generally perpendicular manner, at its second end (50*b*) to the first end (46*a*) of a wire bar (46). The wire bar (46) is inserted through the longitudinal hole of a tubularly shaped roll sleeve (52). Finally, the wire bar (46) is removably attached at its second end (46*b*) to the second end (60*b*) of the retaining bar (60). The retaining bar (60) can be removed from both the swing bar (48) and the wire bar (46) in order that a wire roll (30) may be rotatably placed on the roll sleeve (52). Once the retaining bar (60) is re-attached to the swing bar (48) and the wire bar (46), the wire roll (30) is held in place, but may rotate about its longitudinal axis such that a wire strand (32) can be pulled from the wire roll (30). When it is desirable to not unroll the wire roll (30), the swing-arm assembly (44) can be swung upward and forward about the swing-arm bar (48), or when it is desirable to unroll the wire roll (30), the swing-arm assembly (44) can be swung downward and back. If it is desirable to use a relatively larger sized wire roll (30), then front extension sleeve (56) can be rotatably placed about the swing bar (48), and a rear extension sleeve (54) can be rotatably placed about the wire bar (46). Dependant upon the design criteria for the wire dispensing unit (2) and the swing-arm assembly (44), multiple swing-arm assemblies (44) may be attached to the wire dispensing unit (2).

Figure 7:
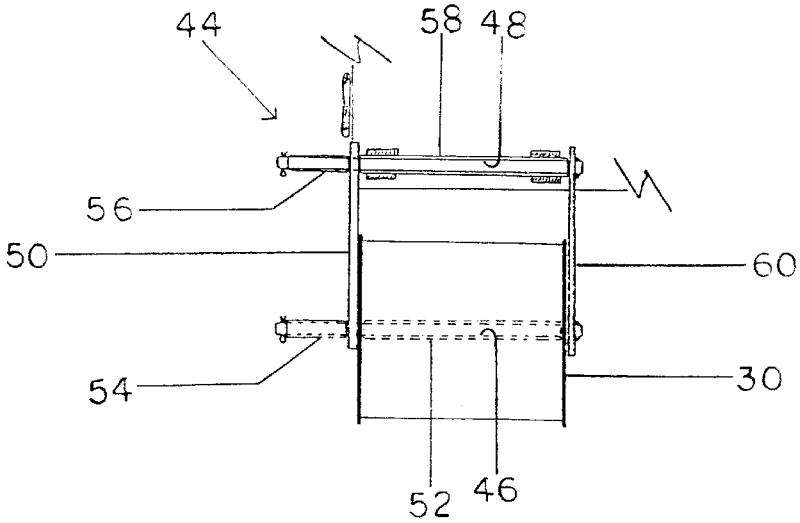
FIG. 7 shows a top view of the swing-arm assembly with an attached wire roll.

FIG. 7 shows a top view of the swing-arm assembly (44) with an attached wire roll (30). The wire roll (30) has been placed over the wire bar (46) and roll sleeve (52). Because this figure depicts a relatively small wire roll (30), the figure shows the retaining bar (60) placed inside the rear wire extension sleeve (54) and front wire extension sleeve (56). If necessitated by a larger wire roll (30), the rear and front wire extension sleeves (54 and 56) would have been placed inside the retaining bar (60).

Although the invention has been described with reference specified embodiments, this description is not meant to be construed in living sense. There is modifications of the disclosed embodiments, various modifications of the disclosed embodiments, as well as alternative embodiments of the invention, will become apparent to persons skilled in the art upon reference the description of the invention. It is therefore contemplated that the appended claims will cover such modifications that fall within the true scope of the invention.

I claim:

1. An apparatus for dispensing rolled wire comprising, a frame having a deck, said deck having a top surface;

two rear wheels, each of said wheels rotatably attached to said fame, said rear wheels lying along an axial axis;

a post attached generally perpendicularly to said deck;

a yoke rotatably attached to said top surface of said deck rearward from a front edge of said deck, wherein said yoke limits the upward travel angle of said front edge of said deck when said frame pivots about said axial of said rear wheels; and said yoke having a means for attachment.

2. An apparatus for dispensing rolled wire comprising:

a frame having a deck;

two wheels, each of said wheels rotatably attached to said frame;

a post attached generally perpendicularly to said deck, a yoke rotatably attached to said deck rearward from a front edge of said deck;

said yoke having a means for attachment, a multipost deck having an aperture sized and located such that said post may be inserted though said multipost deck aperture thereby allowing said multipost deck to rest upon said deck, and two pots attached generally perpendicularly to said multipost deck.

3. The apparatus of claim 1, further comprising:

a handle attached to said yoke.

4. An apparatus for dispensing rolled wire comprising.

a frame having a deck;

two wheels, each of said wheels rotatably attached to said frame;

a post attached generally perpendicularly to said deck;

a yoke rotatably attached to said deck rearward from a front edge of said deck;

said yoke having a means for attachment;

a generally u-shaped swing-arm assembly having a wire bar distal to and generally horizontal to a swing bar:

a first end of said wire bar attached generally perpendicularly to a first end of a side bar, a second end of said side bar attached generally perpendicularly to a first end of said swing bar; and said swing bar rotatably attached to said frame by a swing-arm hinge such that said wire bar may be rotated forward over said deck, or rotated backward behind said deck.

5. The apparatus of claim 4, said swing-arm assembly further comprising:

a retaining bar removably attached at a first end to a second end of said swing bar; and said retaining bar removably attached at a second end to a second end of said wire bar.

* * * * *